US010780570B2

(12) United States Patent
Franke

(10) Patent No.: US 10,780,570 B2
(45) Date of Patent: Sep. 22, 2020

(54) SURFACE-TREATMENT APPLIANCE

(71) Applicant: Rudolf Franke, Bensheim (DE)

(72) Inventor: Rudolf Franke, Bensheim (DE)

(73) Assignee: HAWIG MASCHINENFABRIK GESELLSCHAFT MIT BESCHRÄNKTER HAFTUNG, Bensheim (DE)

( * ) Notice: Subject to any disclaimer, the term of this patent is extended or adjusted under 35 U.S.C. 154(b) by 79 days.

(21) Appl. No.: 16/044,596

(22) Filed: Jul. 25, 2018

(65) Prior Publication Data

US 2019/0030704 A1 Jan. 31, 2019

(30) Foreign Application Priority Data

Jul. 26, 2017 (DE) ..... 10 2017 212 873

(51) Int. Cl.

| | |
|---|---|
| ***B25G 3/38*** | (2006.01) |
| ***A47L 11/40*** | (2006.01) |
| ***B25G 1/06*** | (2006.01) |
| ***A47L 11/30*** | (2006.01) |
| ***A47L 9/32*** | (2006.01) |

(52) U.S. Cl.

CPC ..... *B25G 3/38* (2013.01); *A47L 9/32* (2013.01); *A47L 11/302* (2013.01); *A47L 11/4041* (2013.01); *A47L 11/4075* (2013.01); *B25G 1/06* (2013.01); *A47L 11/4044* (2013.01)

(58) Field of Classification Search

CPC ..... A47L 11/302; A47L 11/4041; A47L 11/4044; A47L 11/4075; A47L 9/32; B25G 1/06; B25G 3/38

See application file for complete search history.

(56) References Cited

U.S. PATENT DOCUMENTS 1,477,685 A * 12/1923 Bostwick ..... B25G 3/38 15/146
2,641,513 A * 6/1953 Fryda ..... B25G 3/38 403/71
3,850,533 A 11/1974 Thielen (Continued)

FOREIGN PATENT DOCUMENTS

DE 64748 C * 12/1891
DE 64748 10/1892
EP 0568110 A2 * 11/1993 ..... A47L 13/253

(Continued)

OTHER PUBLICATIONS

DE-64748-C—English Machine Translation (Year: 1891).*

(Continued)

*Primary Examiner* — Marc Carlson
(74) *Attorney, Agent, or Firm* — Flynn Thiel, P.C.

(57) ABSTRACT

Surface-treatment appliance having a base arrangement, which in a functional position can be displaced on a surface which is to be treated, and having a guide part articulated on the base arrangement and intended for controlling the base arrangement manually. An arcuate guide is provided on the base arrangement, on which can be displaced in a linear manner a carriage body. The carriage body is connected to the guide part and is supported on the arcuate guide, at least in the radial direction, by at least two supporting points, which are spaced apart from one another along the arcuate guide.

18 Claims, 7 Drawing Sheets

(56) References Cited

U.S. PATENT DOCUMENTS

| | | | | |
|---|---|---|---|---|
| 5,440,828 | A * | 8/1995 | Simpson | B25G 3/38<br>172/372 |
| 2015/0113757 | A1* | 4/2015 | Franke | A47L 7/0023<br>15/320 |

FOREIGN PATENT DOCUMENTS

| | | | | |
|---|---|---|---|---|
| GB | 139510 | | 2/1921 | |
| GB | 139510 | A * | 2/1921 | A47L 11/38 |
| GB | 851107 | A | 10/1960 | |

OTHER PUBLICATIONS

Office Action of German Patent Office in German Application No. 10 2017 212 873.9 dated May 4, 2018 (5 pages).
Office Action of European Patent Office issued in European Application No. 18181281.9 with English translation of category of cited documents dated Feb. 4, 2019 (8 pages).

* cited by examiner

SURFACE-TREATMENT APPLIANCE

CROSS-REFERENCE TO RELATED APPLICATIONS

This claims priority from German Patent Application No. DE 10 2017 212 873.9, filed Jul. 26, 2017, the disclosure of which is hereby incorporated by reference in its entirety.

TECHNICAL FIELD

The invention relates to a surface-treatment appliance having a base arrangement, which in a functional position can be displaced on a surface which is to be treated, and having a guide part, which is articulated on the base arrangement and is intended for controlling the base arrangement manually.

BACKGROUND

Such a surface-treatment appliance is generally known in the field of floor-cleaning and floor-care appliances. The known surface-treatment appliance constitutes a scrubbing suction machine which is provided for the wet cleaning of floor surfaces. The scrubbing suction machine has a guide part with at least one handgrip. The guide part is articulated on a base arrangement, which in a functional position of the scrubbing suction machine can be displaced on a floor surface which is to be treated. The base arrangement has at least one tool which can be rotated by means of a drive and also a suction-strip arrangement, which is assigned to the tool. In order for the base arrangement to be controlled manually, an operator can grip, and move, the guide part by hand.

SUMMARY

The object of the invention is to create a surface-treatment appliance of the type mentioned in the introduction which provides for improved handling capability in relation to the prior art.

This object is achieved by the provision, on the base arrangement, of an arcuate guide, on which can be displaced in a linear manner a carriage body, which is connected to the guide part and is supported on the arcuate guide, at least in the radial direction, by means of at least two supporting points which are spaced apart from one another along the arcuate guide. Providing the arcuate guide and the carriage body, which can be displaced linearly on the arcuate guide, achieves improved movement capability of the guide part in relation to the base arrangement. In particular, it is possible for the guide part thus to be pivoted over a wide angle range in relation to the base arrangement and thus to be pivoted straightforwardly, for example, out of an operating region. This provides for particularly straightforward and precise handling capability. Accordingly, surface regions which are otherwise difficult to reach can be accessed more easily and cleaned to better effect. In addition, support for the carriage body, at least in the radial direction, by means of at least two supporting points which are spaced apart from one another along the arcuate guide provides for an improved introduction of forces and/or moments from the guide part into the base arrangement. As a result of this radial support, it is possible in particular for a moment which acts transversely to the radial direction and which an operator can apply to the guide part by means of manual force, as it were a force couple, to be introduced into the base arrangement. This means that a positioning force acting between the base arrangement and the surface which is to be treated can be influenced easily and precisely, should this be so desired by the operator. Accordingly, it is, for example, possible for individual regions of the base arrangement to be subjected to loading and/or relieved of loading in a specific manner in relation to the surface which is to be treated, and this can improve, on the one hand, the treatment result achievable and, on the other hand, the manual control capability of the base arrangement. In contrast, it has additionally been found that an undesirable introduction of forces and/or moments which can otherwise be applied to the base arrangements, for example, by pulling or pushing on the guide part, for example in the form of a pitching moment, is advantageously reduced by the solution according to the invention. To that extent, the solution according to the invention can reduce the amount by which forces acting on the guide part influence the base arrangement in an undesirable manner. The base arrangement can advantageously have at least one drive, a tool which can be rotated by means of the drive and/or also a suction-strip arrangement. The guide part can advantageously be designed in the form of a handle, of a push-bar, of a shaft or the like. The arcuate guide can advantageously form a portion of the base arrangement, and therefore, for example, further components of the base arrangement, in particular a tool or a drive, can be arranged directly on the arcuate guide. As seen in relation to the vertical direction, the arcuate guide advantageously projects upward in relation to a base surface area of the base arrangement, at least part of said base surface area in the functional position being arranged opposite the surface which is to be treated. The arcuate guide can have, in particular, a rectangular, a round or an oval cross section and be produced, for example, from a flat material or a round material. The carriage body can be supported, in particular with slide-bearing and/or rolling-bearing action, on the arcuate guide by means of the supporting points. The term "supporting points" here, within the context of the invention, covers support at a point, along a line and/or over a surface area. Within the context of the invention, "along the arcuate guide" means in the direction of the main extent of the arcuate guide and, to that extent, in the direction of an arcuately curved guide path which is formed by means of the arcuate guide and on which the carriage body can be moved in a linear manner. In addition, the directional information "radial(ly)" relates to the arcuate shape or the radius of the arcuate guide. Further directional information such as longitudinal direction, transverse direction or vertical direction relate to a coordinate system of the surface-treatment appliance, which in the functional position is arranged on a planar horizontal surface.

In one configuration of the invention, the arcuate guide is curved continuously and in the same direction. This achieves functionally effective and straightforward displacement capability of the carriage body on the arcuate guide. As seen in a transversely oriented direction, the arcuate guide is advantageously curved convexly. Accordingly, it is advantageously possible for an apex of the arcuate guide to be arranged in an upper region of the arcuate guide.

In a further configuration of the invention, the arcuate guide is made to extend in the form of a circular arc over an angle of at least largely 90°. Such an angular extent can provide for sufficient movement capability of the guide part in relation to the base arrangement, the overall volume at the same time being small. The arcuate guide can preferably be made to extend in the form of a circular arc over an angle of at least largely 120°. Such an angular extent can provide for even better movement capability of the guide part in relation to the base arrangement, the overall volume at the same time being moderate. The arcuate guide can particularly preferably be made to extend in the form of a circular arc over an angle of at least largely 180°. Such an angular extent can provide for more or less optimum movement capability of the guide part in relation to the base arrangement. For example, the guide part can advantageously be pivoted easily from one side of the base arrangement to an opposite side, without the base arrangement having to be repositioned for this purpose. This means that the guide part can be swung down on either side essentially flat and, to that extent, parallel to the surface which is to be treated. Accordingly, the base arrangement can be maneuvered, for example, straightforwardly beneath an obstacle or the like.

In a further configuration of the invention, the arcuate guide is made to extend over the base arrangement. The arcuate guide can advantageously be connected at each end to a front portion and a rear portion of the base arrangement, the arcuate guide therefore extending essentially over a longitudinal extent of the base arrangement.

In a further configuration of the invention, the arcuate guide is mounted on the base arrangement such that it can be pivoted about a pivot axis, which is located at least largely in a guide plane of the arcuate guide. "Guide plane" here means an imaginary plane which is defined by end points of the arcuate guide and a point on the arcuate guide which is arranged between said end points. In other words, the pivot axis can advantageously be oriented coaxially in relation to, or parallel to, an axis which connects the end points of the arcuate guide. This achieves even better manual handling capability of the surface-treatment appliance. In particular, it is thus possible for the base arrangement to be rotated on the spot while, at the same time, the guide part is positioned obliquely in relation to the base arrangement, i.e. has been swung down out of the vertical direction. This is because the arcuate guide, together with the carriage body and the pivot axis, forms, as it were, a kind of universal-joint arrangement. It is thus possible for the base arrangement, essentially irrespective of the angular position of the guide part in relation to the base arrangement, to be rotated on the spot, on the surface which is to be treated, by means of a torque acting on the guide part.

In a further configuration of the invention, the pivot axis is made to extend essentially parallel to a base surface area of the base arrangement. In particular, it is additionally possible for the pivot axis to be arranged directly above the base arrangement. The base surface area of the base arrangement should be understood to mean that surface of which in the functional position at least part is arranged opposite the surface which is to be treated and, to that extent, is oriented essentially parallel to said surface. Such a parallel extent of the pivot axis can provide for on-the-spot rotation of the base arrangement even when the angular position of the guide part in relation to the base arrangement is flat, in particular more or less horizontal. If the pivot axis is arranged directly above the base arrangement, i.e. at a small distance from the surface which is to be treated, it is possible to achieve a low-level point of action of the forces which can be transmitted between the guide part and the base arrangement. This configuration of the invention can further reduce the amount by which the base arrangement is influenced in an undesirable manner by moments applied by the guide part. In particular, an undesirable pitching moment can be reduced in this way.

In a further configuration of the invention, the carriage body has at least one supporting element, in particular in the form of a sliding or rolling element, which is supported on the arcuate guide in the radial direction and forms at least a first one of the supporting points. It is possible for the supporting element to be supported on the arcuate guide at a point, along a line and/or over a surface area and, to that extent, to form the first one of the supporting points. The sliding element can be designed in the form of a sliding shoe, of a sliding block or the like. The rolling element can be designed in the form of a ball-shaped, roller-shaped, needle-shaped or barrel-shaped rolling body. To that extent, the arcuate guide can have a guide portion which is designed to complement the shape of the supporting element, and is for example in the form of a correspondingly complementary guide path, for interacting with such a sliding or rolling element. This provides for low-friction movement of the carriage body on the arcuate guide. It is particularly advantageous if a plurality of supporting elements are arranged along the arcuate guide.

In a further configuration of the invention, the carriage body has at least one counter-support element, in particular in the form of a sliding counter-support element or rolling counter-support element, which is supported on the arcuate guide from the opposite side in relation to the supporting element, as seen in the radial direction, and forms at least a second one of the supporting points. It is thus possible for the carriage body to be supported on the arcuate guide on either side, as seen in the radial direction, or in other words: in the radially inward direction and radially outward direction, by means of the supporting element and of the counter-support element. This means that a force couple can be introduced into the arcuate guide, low-friction movement of the carriage body being achieved at the same time. It is possible for the counter-support element to be supported on the arcuate guide at a point, along a line and/or over a surface area and, to that extent, to form the second one of the supporting points. The sliding counter-support element can be designed, in particular, in the form of a sliding shoe, of a sliding block or the like. The rolling counter-support element can be designed, in particular, in the form of a ball-shaped, roller-shaped, needle-shaped or barrel-shaped rolling body. To that extent, the arcuate guide can have a counter-guidance portion which is designed to complement the shape of the counter-support element, and is for example in the form of a correspondingly complementary counter-guidance path, for interacting with such a sliding counter-support element or rolling counter-support element. This provides for particularly low-friction movement of the carriage body on the arcuate guide. It is particularly advantageous if a plurality of counter-support elements are arranged one behind the other along the arcuate guide.

In a further configuration of the invention, the carriage body is supported on the arcuate guide in the lateral direction such that a torque acting about a longitudinal axis of the guide part can be transmitted to the arcuate guide, and therefore to the base arrangement, via the carriage body. "In the lateral direction" means oriented essentially transversely to the arcuate guide and, to that extent, essentially perpendicularly to the radial direction of the arcuate guide. The carriage body can advantageously be supported thus in the lateral direction by means of at least one sliding or rolling element. It is thus possible to achieve low-friction movement of the carriage body during on-the-spot rotation of the base arrangement and therefore even better handling of the surface-treatment appliance.

In a further configuration of the invention, the arcuate guide has a round cross section and the carriage body engages around the cross section, at least in part, in particular by means of at least one bearing sleeve. The arcuate guide is produced preferably from a round material and can have, for example, a tubular hollow cross section or a cylindrical solid cross section. The carriage body engages around the cross section of the arcuate guide in the manner of a sleeve. For this purpose, the carriage body can have at least one bearing sleeve. The bearing sleeve can be made to extend longitudinally over essentially the entire length of the carriage body, and this therefore achieves full-surface-area bearing along the cross section of the arcuate guide. As an alternative, it is possible to provide a plurality of bearing sleeves, for example two bearing sleeves, and to arrange these at opposite ends of the carriage body. This provides for bearing of the carriage body merely along certain regions of the cross section of the arcuate guide. The bearing sleeve can be configured, for example, in the form of a sliding sleeve. Of course, it is also possible for the at least one bearing sleeve to be configured as a basically known linear ball-bearing in the form of a ball sleeve, which can also be referred to as a shaft guide, and this provides for the carriage body to be guided with rolling-bearing action on the round cross section of the arcuate guide.

In a further configuration of the invention, the guide part is connected to the carriage body by means of a joint element having a joint axis, wherein the joint axis is oriented essentially parallel to a guide plane of the arcuate guide. This achieves even better manual control capability and/or handling of the surface-treatment appliance. Within the context of this invention, "guide plane" means an imaginary plane which is defined by end points of the arcuate guide and a point on the arcuate guide which is arranged between said end points. In particular, it is thus possible for the base arrangement to be rotated on the spot while, at the same time, the guide part is positioned obliquely in relation to the base arrangement, i.e. has been swung down out of the vertical direction. This is because the arcuate guide, together with the carriage body and the joint element, forms, as it were, a kind of universal-joint arrangement. It is thus possible for the base arrangement, essentially irrespective of the angular position of the guide part in relation to the base arrangement, to be rotated on the spot, on the surface which is to be treated, by means of a torque acting on the guide part. The joint element can be designed in the form of an articulated joint, a hinge which is movable to both sides, or the like.

BRIEF DESCRIPTION OF THE DRAWINGS

Further advantages and features of the invention can be gathered from the claims and from the following description of preferred exemplary embodiments of the invention, which are illustrated with reference to the drawings, in which:

DETAILED DESCRIPTION

The surface-treatment appliances 1, 1*a and* 1*b* according to the invention are each provided in the form of a scrubbing suction machine for cleaning floor surfaces. Quite apart from this, it is, of course, also possible for the solution according to the invention to be used in conjunction with surface-treatment appliances which are configured in a manner different from such a scrubbing suction machine.

As far as the structural and functional features are concerned, the embodiments of surface-treatment appliances 1, 1*a* and 1*b* according to the invention are constructed in an essentially corresponding manner. To that extent, components and portions which are identical for the surface-treatment appliances 1 to 1*b* are provided with identical reference signs. In order to avoid repetition, such identical components and portions are not explained separately for each of the embodiments. Functionally identical components and portions which nevertheless differ in design have been designated by identical reference-sign numbers with lower-case letters added.

Figure 1:
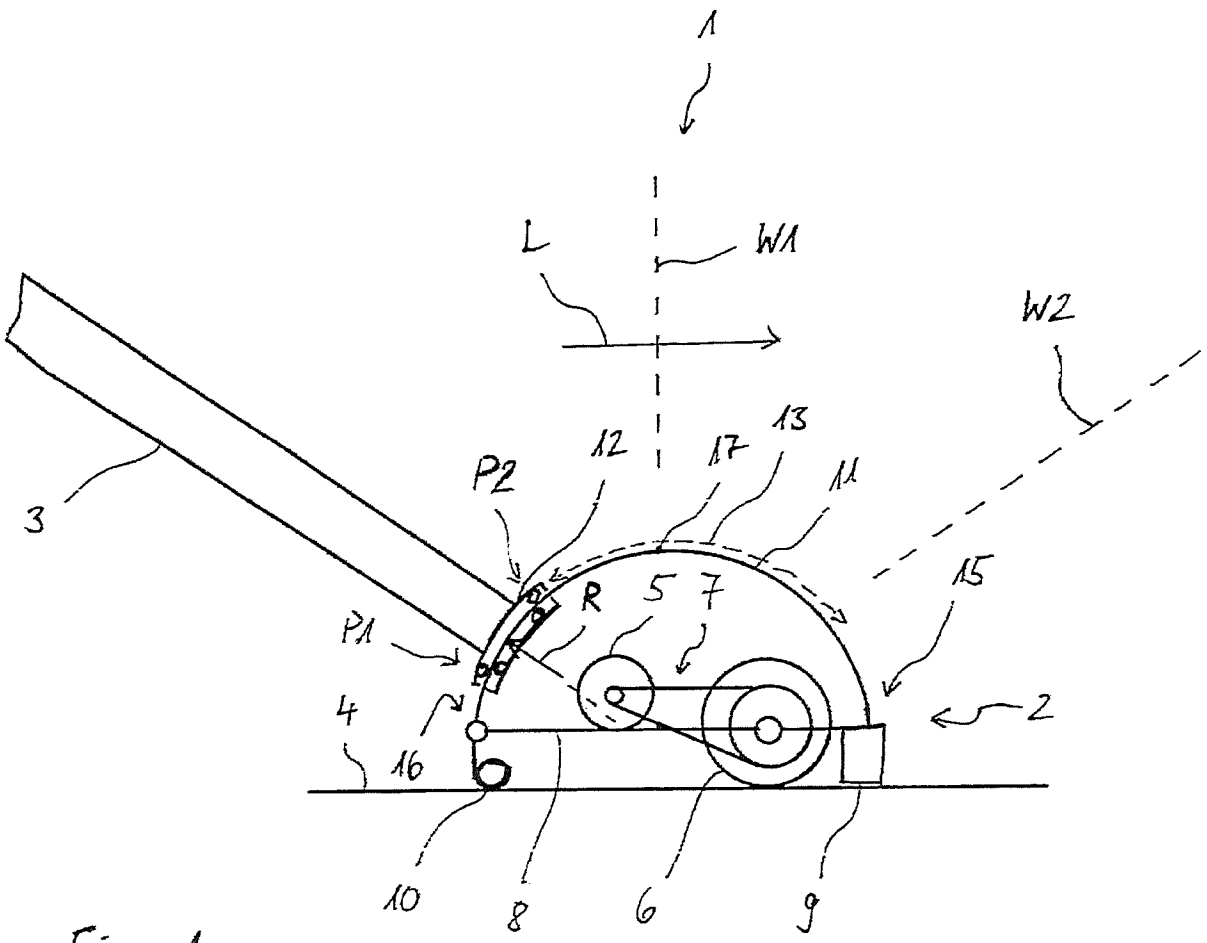
FIG. 1 shows a schematic side view of a first embodiment of a surface-treatment appliance according to the invention having a base arrangement, an arcuate guide, a carriage body and a guide part.

As can be seen with reference to FIG. 1, the surface-treatment appliance 1 has a base arrangement 2 and a guide part 3, which is articulated on the base arrangement 2. In a functional position which can be seen with reference to FIG. 1, the base arrangement 2 can be displaced on a surface 4 which is to be treated. The base arrangement 2 has a surface-treatment tool 6, which can be driven by means of a drive 5 and is in the form of a floor-scrubbing roller. In order to transmit driving forces, the drive 5 is connected to the surface-treatment tool 6 via a force-transmission element 7 in the form of a belt drive. The drive 5 is secured on the base arrangement 2 in a manner which will not be described in any more detail, but is known. The surface-treatment tool 6 is connected to the base arrangement 2 by means of a longitudinally extending connecting element 8. The base arrangement 2 also has a suction-strip arrangement 9, which is assigned to the surface-treatment tool 6. The suction-strip arrangement 9 can be provided in order to suction up dirty water which arises during the wet cleaning of the floor surface 4. In addition, the base arrangement 2 has an end wheel 10, which in the functional position is supported on the surface 4 which is to be treated. In addition, it is readily clear to a person skilled in the art here that, instead of the aforementioned components, it is possible for the base arrangement to be provided as an alternative, or in addition, with further components adapted to the respective treatment purpose. For example, instead of the roller-like surface-treatment tool 6 which has its circumference positioned against the surface 4 which is to be treated, the base arrangement 2 can have a plate-like surface-treatment tool, which can have its end surface positioned against the surface 4 which is to be treated. To that extent, it is also the case that providing the suction-strip arrangement 9 is not imperative.

The guide part 3 is configured in the form of a longitudinally extending shaft and is provided for controlling the base arrangement 2 manually. For this purpose, at its end region which cannot be seen specifically, and is directed away from the base arrangement 2, the guide part 3 has at least one grip in order for the surface-treatment appliance 1 to be guided manually by an operator. To that extent, the base arrangement 2 can be displaced, and positioned, on the surface 4 which is to be treated by virtue of the operator introducing corresponding forces and/or moments via the guide part 3.

As can also be seen with reference to FIG. 1, an arcuate guide 11 is provided on the base arrangement 2. A carriage body 12, which is connected to the guide part 3, can be displaced linearly on said arcuate guide 11 along a schematically indicated guide direction 13 of the arcuate guide 11. The carriage body 12 is supported on the arcuate guide 11 at least in the radial direction R by means of at least two supporting points P1, P2 which are spaced apart from one another along the arcuate guide 11. As a result of this linear displacement capability of the carriage body 12 along the arcuate guide 11, the guide part 3 can be shifted in an arcuate manner out of the angular position in relation to the base arrangement 2 which can be seen with reference to FIG. 1, for example, into an angular position W1 and/or an angular position W2, both indicated by dashed lines in the illustration of FIG. 1, and any desired number of intermediate positions. In order to achieve such linear displacement capability of the carriage body 12, the latter is supported with slide-bearing and/or rolling-bearing action on the arcuate guide 11 in a manner which is yet to be explained in more detail and can be seen, in particular, with reference to FIGS. 4*a* to 5*b*.

As can also be seen with reference to FIG. 1, the arcuate guide 11 is curved continuously and in the same direction and, to that extent, is made to extend in the form of a circular arc over an angle of at least largely 180°. Quite apart from this, sufficient angular movement capability of the guide part 3 in relation to the base arrangement 2 can be achieved even when the arcuate guide 11 is made to extend over an angle of at least largely 120° or of at least largely 90°.

It is also the case that the arcuate guide 11 is secured at each of its end regions on a front region 15 of the base arrangement 2 and on a rear region 16 of the base arrangement 2. To that extent, the arcuate guide 11 is made to extend over the base arrangement 2, in particular over the length thereof. An apex 17 of the arcuate guide 11 here is arranged, essentially as seen in relation to a longitudinal direction L, centrally between the front region 15 and the rear region 16 of the base arrangement 2.

Figure 2:
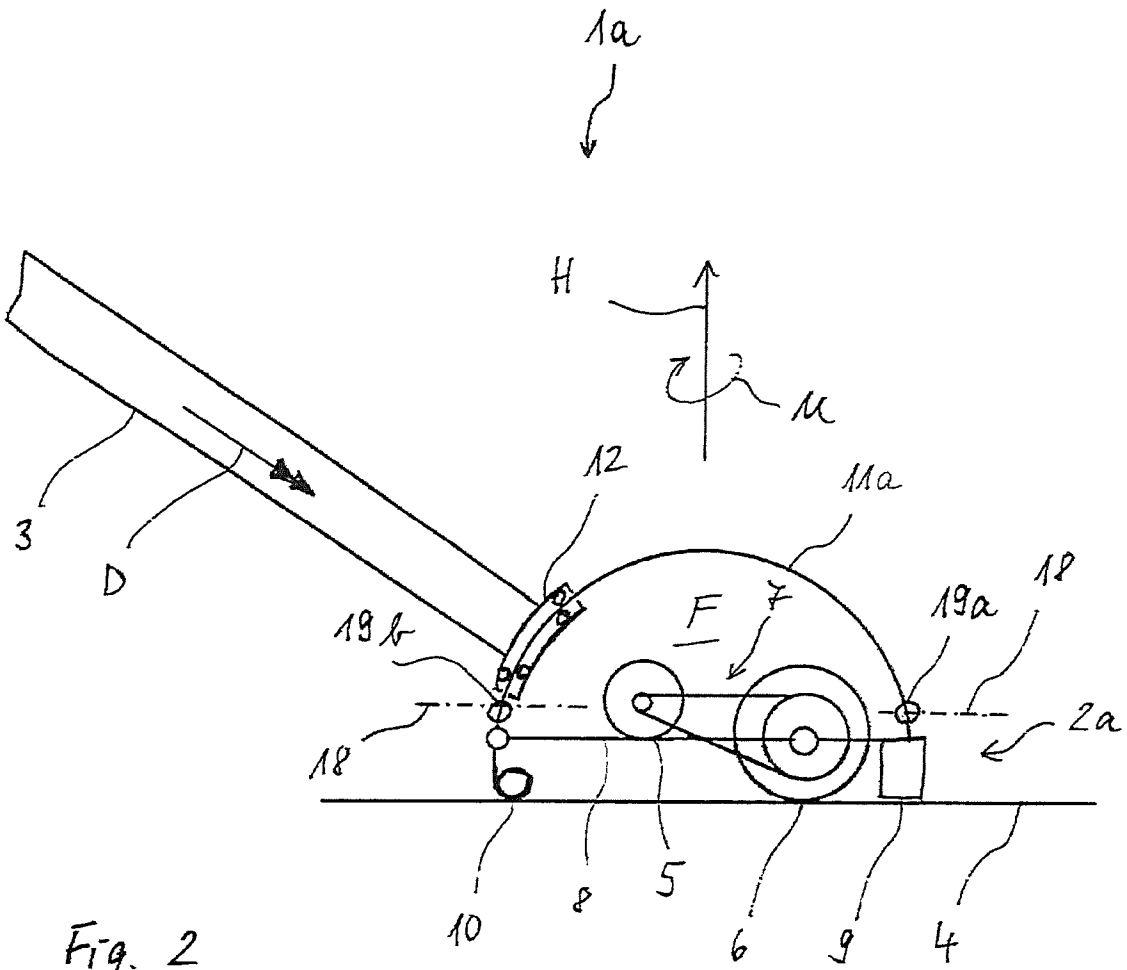
FIG. 2 shows a schematic side view of a further embodiment of a surface-treatment appliance according to the invention, wherein the arcuate guide is mounted on the base arrangement such that it can be pivoted about a pivot axis, FIGS. 2*a* and *b* each show a schematic plan view of the surface-treatment appliance according to FIG. 2 in a first position (FIG. 2*a*) and a second position (FIG. 2*b*), which is shifted in relation to the first position.

FIG. 2 shows a further embodiment in the form of the surface-treatment appliance 1*a* that, as far as its design and functional configuration are concerned, corresponds essentially with the surface-treatment appliance 1 according to FIG. 1. In order to avoid repetition, it is only the differences exhibited by the surface-treatment appliance 1*a* in relation to the surface-treatment appliance 1 which will be discussed hereinbelow.

Figure 2A:
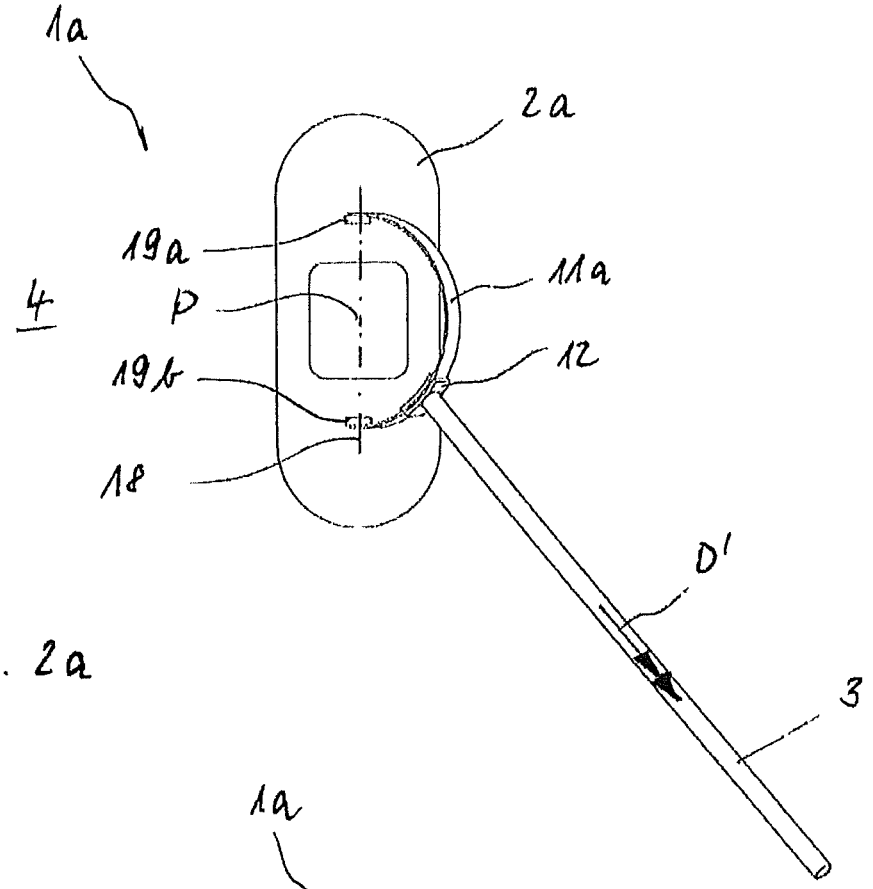
Figure 2B:
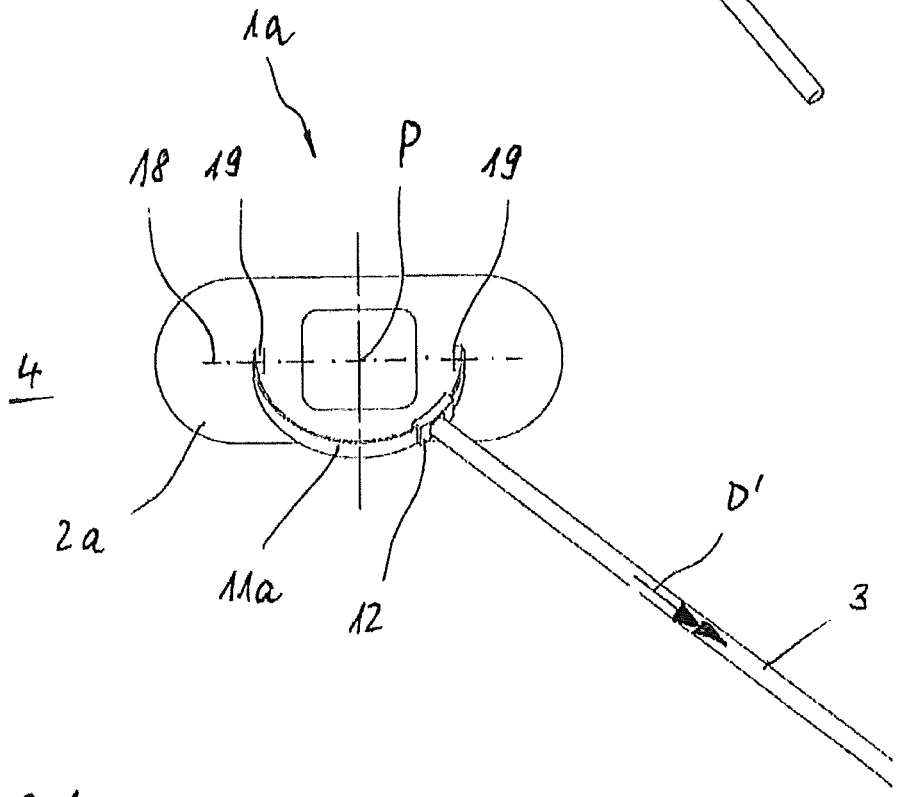

To that extent, the surface-treatment appliance 1*a* differs essentially in that the arcuate guide 11*a* is mounted on the base arrangement 2*a* such that it can be pivoted about a pivot axis 18. The pivot axis 18 is located at least largely in a guide plane F of the arcuate guide 11*a*, said guide plane being defined by three imaginary points, for example front and rear end points and the apex 17, arranged along the arcuate guide 11*a*. For this purpose, the arcuate guide 11*a* is connected in a pivotable manner to the rest of the components of the base arrangement 2*a* via a front articulated joint 19*a* and a rear articulated joint 19*b*. This gives rise to pivoting capability of the arcuate guide 11*a*, said pivoting capability being oriented transversely to the linear displacement capability of the carriage body 12 along the arcuate guide 11*a*. In this way, the arcuate guide 11*a*, together with the carriage body 12 and the pivot axis 18 and/or the front and rear articulated joints 19*a* and 19*b*, forms a kind of universal-joint arrangement. This kind of joint arrangement provides for on-the-spot rotation of the base arrangement 2*a*, by means of a torque D applied to the guide part 3, essentially irrespective of the angular position of the guide part 3 in each case. If the torque D is applied to the guide part 3, for example, with reference to the direction of rotation indicated in FIG. 2, this gives rise to planar rotation of the base arrangement 2*a* about a vertical axis H in a manner corresponding to a direction of rotation U which can be seen with reference to FIG. 2. Such kinematics of the surface-treatment appliance 1*a* are depicted in more detail with reference to FIGS. 2*a* and 2*b*. In a first position, which can be seen with reference to FIG. 2*a*, the base arrangement 2*a* is arranged in an essentially centered state above an imaginary point P of the surface 4 which is to be treated. The pivot axis 18 here is oriented horizontally in relation to the surface 4 which is to be treated and—as seen in relation to the drawing plane of FIGS. 2*a* and *b*—vertically. In respect of the imaginary vertical axis H (FIG. 2), the arcuate guide 11*a* has been pivoted to the right, as seen in relation to the drawing plane, and thus assumes an angular position of approximately 45° in relation to the surface 4 which is to be treated. The carriage body 12 is positioned on the arcuate guide 11*a* in the region of the rear articulated joint 19*b*, wherein the guide part 3 projects obliquely upward in relation to the surface 4 which is to be treated and—as seen in relation to the drawing plane of FIGS. 2*a* and *b*—downward to the right. Proceeding from the first position, which can be seen with reference to FIG. 2*a*, the introduction of a torque D' acting about the longitudinal axis of the guide part 3 causes the base arrangement 2*a* to rotate in the counterclockwise direction or counter to the direction of rotation U which can be seen with reference to FIG. 2. During this rotation, the guide part 3 remains in an essentially unaltered position in relation to the surface 4 and rotates through approximately 90° about its longitudinal axis. On account of the essentially unaltered position of the guide part 3, and of the above-described rotation of the base arrangement 2*a*, the torque D' causes the guide part 3, and the carriage body 12 arranged on the guide part 3, to move relative to the base arrangement 2*a* and the arcuate guide 11*a*. During this relative movement, the carriage body 12 makes its way along the arcuate guide 11*a*. The arcuate guide 11*a*, in contrast, is tilted in relation to the base arrangement through approximately 90° about the pivot axis 18. Of course, it is also possible for the base arrangement 2 to rotate on the spot through more than the 90° which can be seen with reference to FIGS. 2*a* and *b*.

In addition, the pivot axis 18 is made to extend essentially parallel to the surface 4 which is to be treated. It is, of course, also possible for the pivot axis 18 to be arranged in an inclined state in relation to the surface 4 which is to be treated.

Figure 3:
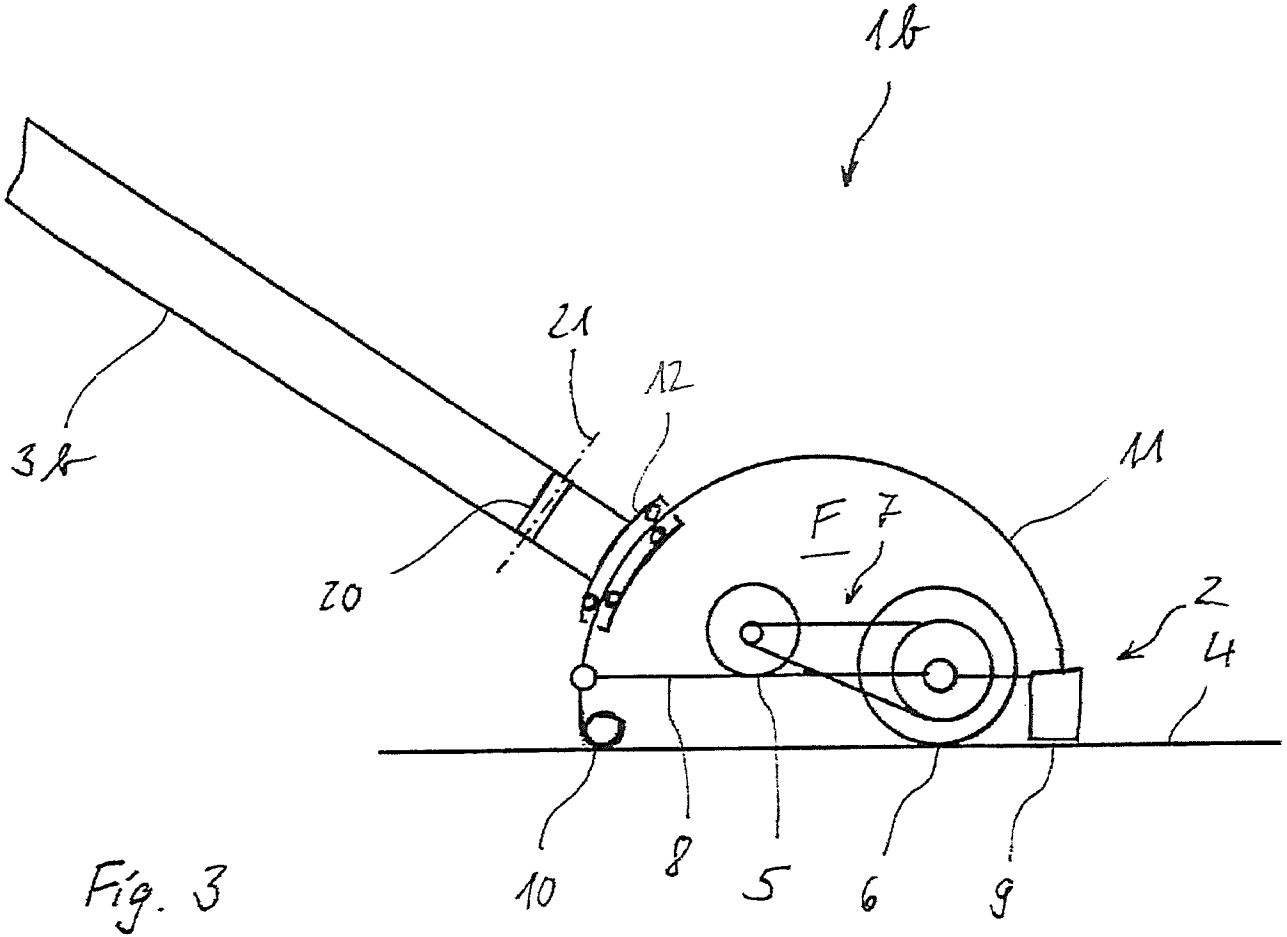
FIG. 3 shows a schematic side view of a further embodiment of a surface-treatment appliance according to the invention, wherein the guide part is connected to the carriage body by means of a joint element, FIGS. 4*a* and *b* show, in a schematic plan view (FIG. 4*a*) and a sectional view (FIG. 4*b*) taken along a section line A-A according to FIG. 4*a*, a carriage body and a region of a first embodiment of an arcuate guide for a surface-treatment appliance according to FIGS. 1 to 3, FIGS. 5*a* and *b* show, in a schematic plan view (FIG. 5*a*) and a sectional view (FIG. 5*b*) taken along a section line B-B according to FIG. 5*a*, a carriage body and a region of a further embodiment of an arcuate guide for a surface-treatment appliance according to FIGS. 1 to 3, and FIGS. 6*a* and *b* show, in a schematic sectional view (FIG. 6*a*) corresponding to the view according to FIGS. 4*b* and 5*b* and a cross section (FIG. 6*b*) taken along section line C-C according to FIG. 6*a*, a carriage body and a region of a further embodiment of an arcuate guide for a surface-treatment appliance according to FIGS. 1 to 3.

The surface-treatment appliance 1*b*, which can be seen with reference to FIG. 3, differs from the surface-treatment appliances 1 and 1*a* according to FIGS. 1 and 2, respectively, essentially in that the guide part 3*b* is connected to the carriage body 12 by means of a joint element 20. The joint element 20 has a joint axis 21. The joint axis 21 is oriented essentially parallel to the guide plane F of the arcuate guide 11, in which the carriage body 12 can be displaced linearly. The joint element 20 is designed in the form of an articulated joint, and therefore, as seen in relation to the drawing plane of FIG. 3, the guide part 3*b* can be pivoted out of said drawing plane and into the same. In this way, the arcuate guide 11, together with the carriage body 12 and the joint element 20, forms, as it were, a kind of universal-joint arrangement. Regardless of the differences in design in relation to the joint arrangement of the surface-treatment appliance 1*a* according to FIG. 2, this joint arrangement here has essentially a corresponding functionality in terms of kinematics. To that extent, the base arrangement 2 of the surface-treatment appliance 1*b* can thus be rotated on the spot in the same manner as the base arrangement 2*a* of the surface-treatment appliance 1*a*.

FIGS. 4*a* to 6*b* show further details relating to the design providing for the support and linear displacement capability of the carriage body 12 on the arcuate guide 11.

Figure 4A:
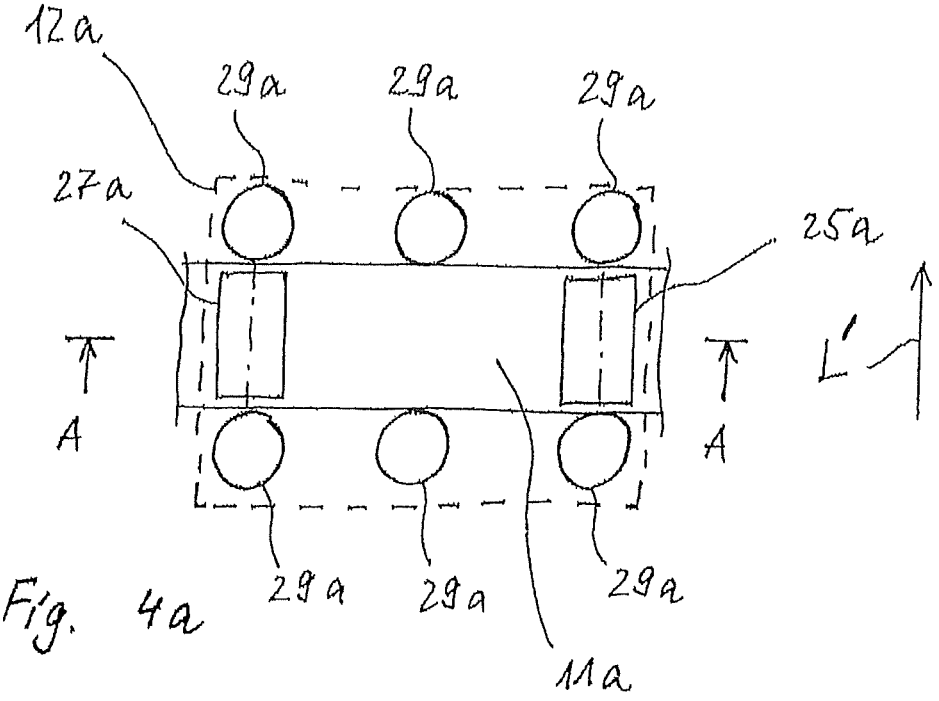
Figure 4B:
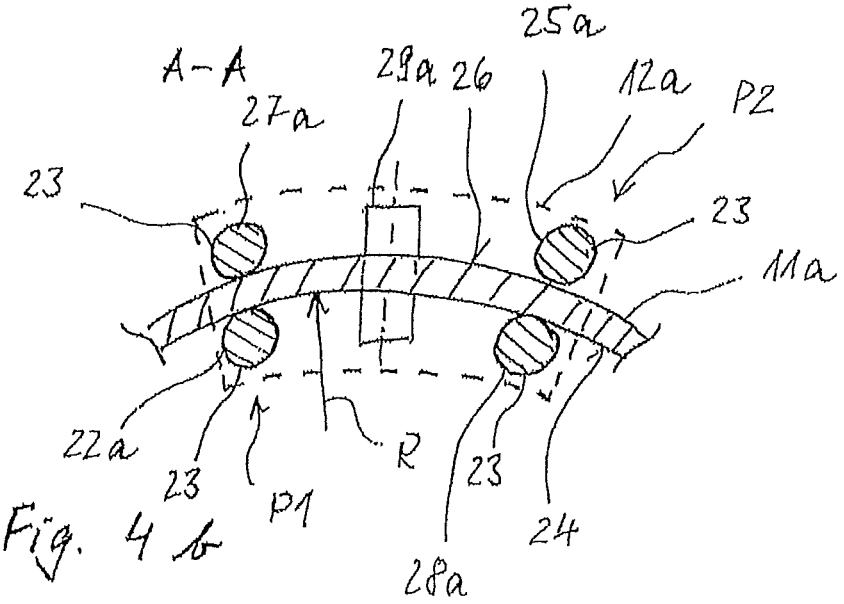

A first configuration which provides for this support can be seen with reference to FIGS. 4*a* and 4*b*. To give a clearer representation, the carriage body 12*a* here is indicated merely by dashed lines. The carriage body 12*a* has a supporting element 22*a* supported on the arcuate guide 11*a* in the radial direction R. The supporting element 22*a* is designed in the form of a rolling element 23. The rolling element 23 is barrel-shaped and is supported in the radial direction R against an inner guide path 24 of the arcuate guide 11*a*, as seen in relation to the radial direction R. In this way, the supporting element 22*a* forms the supporting point P1 of the carriage body 12*a*. Instead of the barrel-shaped configuration of the rolling element 23, it is also possible, of course, to provide a ball-shaped, cone-shaped, needle-shaped or similar configuration. The carriage body 12*a* also has a counter-support element 25*a* supported on the arcuate guide 11*a* from the opposite side in relation to the supporting element 22*a*, as seen in the radial direction R. The counter-support element 25*a* is configured, in a manner corresponding to the supporting element 22*a*, in the form of a rolling element 23 and is supported on an outer guide surface 26 of the arcuate guide 11*a*, as seen in relation to the radial direction R. To that extent, the counter-support element 25*a* forms a second one of the supporting points P1, P2, namely the supporting point P2.

In particular in order to achieve play-free and essentially direction-independent support of the carriage body 12*a*, the latter has further rolling elements 23, each supported along the radial direction R on those regions of the arcuate guide 11*a* which are directed away from the supporting element 22*a* and the counter-support element 25*a*. To that extent, these two rolling elements 23 form a further supporting element 27*a* and a further counter-support element 28*a*.

In addition, the carriage body 12*a* is supported on the arcuate guide 11*a* in the lateral direction L', i.e. in a direction transverse to a main extent of the arcuate guide, such that a torque D (FIG. 2) acting about a longitudinal axis of the guide part 3, 3*b* can be transmitted to the arcuate guide 11*a*, and therefore to the base arrangement 2, 2*a*, via the carriage body 12*a*. For this purpose, the carriage body 12*a* has a plurality of guide elements 29*a* arranged one behind the other along the arcuate guide 11*a*. The guide elements 29*a* are supported on opposite outer surfaces of the arcuate guide 11*a* along the lateral direction L and are each designed in the form of a barrel-shaped rolling element.

Figure 5A:
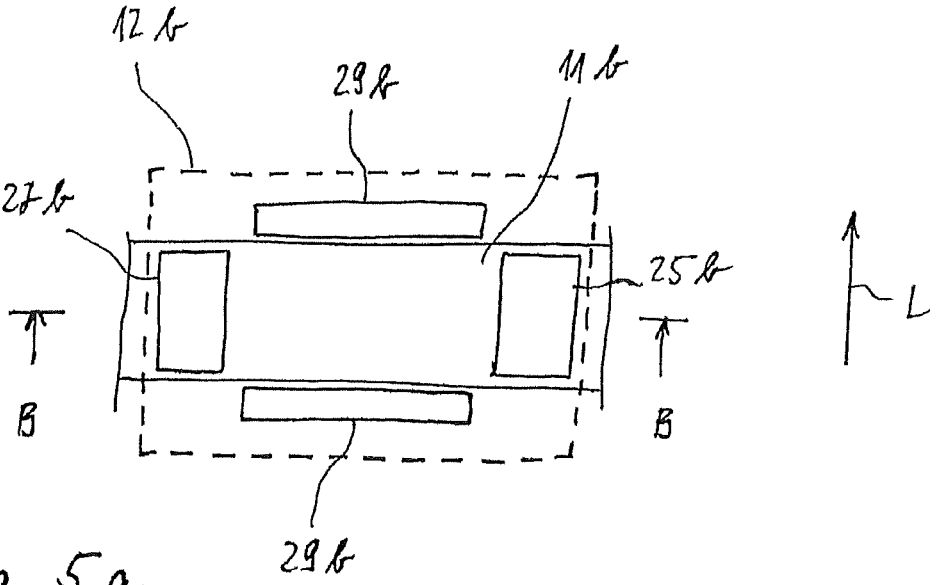
Figure 5B:
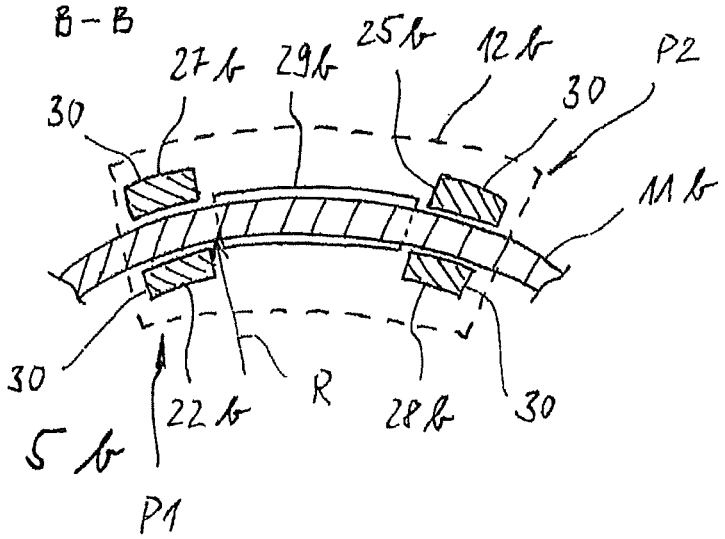

A further design for the linear displacement capability of the carriage body 12 on the arcuate guide 11 can be seen with reference to FIGS. 5*a* and 5*b*. The configuration illustrated there differs from the configuration which can be seen with reference to FIGS. 4*a* and 4*b* essentially in that the supporting elements 22*b*, 27*b* and the counter-support elements 25*b*, 28*b* are designed in the form of sliding elements 30. Accordingly, it is also the case that the guide elements 29*b* for supporting the carriage body 12*b* laterally on the arcuate guide lib are designed in the form of sliding elements.

Figure 6A:
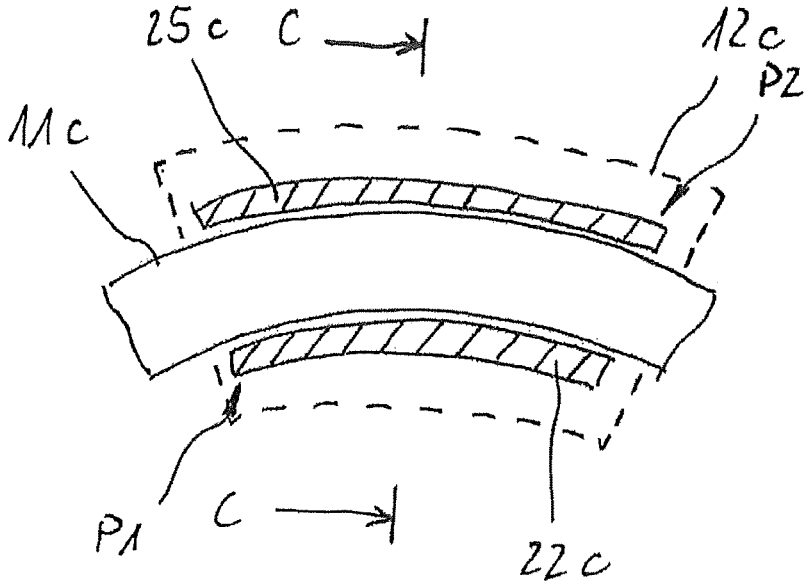
Figure 6B:
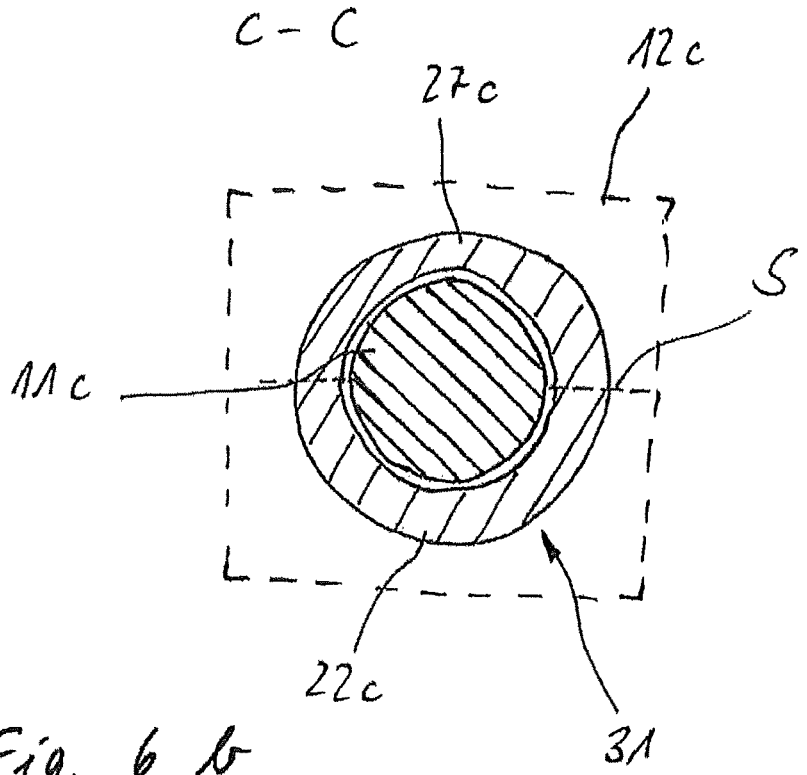

A further design for the linear displacement capability of the carriage body 12 on the arcuate guide 11 can be seen with reference to FIGS. 6*a* and 6*b*. The configuration illustrated there differs from the embodiments according to FIGS. 4*a* and 4*b*, and also FIGS. 5*a* and 5*b*, essentially in that there is an arcuate guide 11*c* provided, which has a round cross section. The arcuate guide 11*c* here is produced from a round material of solid cross section. Of course, it is also possible for a tubular hollow cross section to be provided instead for the arcuate guide 11*c*. The arcuate guide 11*c* has a carriage body 12*c* engaging around it in the circumferential direction. As is depicted with reference to FIG. 6*a*, a lower portion of the carriage body 12*c*, as seen in relation to the drawing plane of FIG. 6*a*, can be taken to be a supporting element 22*c*. Accordingly, an upper portion 25*c* of the carriage body 12*c* can be taken to be a counter-support element 25*c*, which is supported on the arcuate guide 11*c* from the opposite side in relation to the supporting element 22*c*, as seen in the radial direction. As can be seen with reference to the cross-sectional illustration of FIG. 6*b*, the carriage body 12*c* has a bearing sleeve 31. The bearing sleeve 31 engages all the way around the circular-cylindrical cross section of the arcuate guide 11*c* in the circumferential direction. Instead of engagement all the way around in this way, it is possible to provide for, for example, engagement only part of the way around. This latter is the case, for example, when the bearing sleeve 31 is slit or is subdivided into sub-elements, which is intended to be depicted in FIG. 6*b* by means of the schematically indicated parting plane S. The bearing sleeve 31 extends continuously along the arcuate guide 11*c* and essentially over the entire length of the carriage body 12*c*. It is also possible, instead, to provide two bearing sleeves which are considerably shorter than the bearing sleeve 31, in which case the bearing sleeves are arranged opposite one another at the ends of the carriage body 12*c*. The bearing sleeve 31 here is provided in the form of a separate machine element, which is connected to the rest of the components of the carriage body 12*c*. As an alternative, the bearing sleeve 31 can be formed in one piece with the carriage body 12*c*. The carriage body 12*c* can be displaced with slide-bearing action along the arcuate guide 11*c* by means of the bearing sleeve 31. To that extent, the bearing sleeve 31 is designed in the form of a sliding sleeve. It is also possible, instead, for the bearing sleeve 31 to be configured in the form of a linear ballbearing, which is known in principle, and this makes it possible for the carriage body 12*c* to be displaced with rolling-bearing action on the arcuate guide 11*c*.

It is, of course, possible for the above-described configurations providing for the support of the carriage bodies 12*a*, 12*b* and 12*c* on the respective arcuate guide 11*a*, 11*b* and 11*c* to be provided on the surface-treatment appliance 1, 1*a* and 1*b* irrespective of the embodiment of the latter in each case.

The invention claimed is:

1. A surface-treatment appliance having a base arrangement, the base arrangement in a functional position being displaceable over a surface to be treated, the surface-treatment appliance having a guide part articulated on the base arrangement for controlling the base arrangement manually, the surface-treatment appliance further including an arcuate guide on the base arrangement, a carriage body displaceable on the arcuate guide in a linear manner, the carriage body being connected to the guide part and supported on the arcuate guide, at least in a radial direction, by at least two supporting points spaced apart from one another along the arcuate guide, the guide part being connected to the carriage body by a joint element having a joint axis oriented essentially parallel to a guide plane of the arcuate guide, the joint element permitting movement of the guide part relative to the carriage body about the joint axis.

2. The surface-treatment appliance according to claim 1, wherein the arcuate guide is curved continuously and in the same direction.

3. The surface-treatment appliance according to claim 1, wherein the arcuate guide extends in the form of a circular arc over an angle of at least largely 90°.

4. The surface-treatment appliance according to claim 1, wherein the arcuate guide extends over the base arrangement.

5. The surface-treatment appliance according to claim 1, wherein the carriage body has at least one supporting element, the supporting element comprising a sliding element or a rolling element supported on the arcuate guide in the radial direction and forming at least a first one of the two supporting points.

6. The surface-treatment appliance according to claim 5, wherein the carriage body has at least one counter-support element comprising a sliding counter-support element or a rolling counter-support element supported on the arcuate guide opposite the supporting element, as seen in the radial direction, the counter-support element forming at least a second one of the two supporting points.

7. The surface-treatment appliance according to claim 1, wherein the carriage body is supported on the arcuate guide in a lateral direction such that a torque acting about a longitudinal axis of the guide part is transmitted to the arcuate guide, and therefore to the base arrangement, via the carriage body.

8. The surface-treatment appliance according to claim 1, wherein the arcuate guide has a round cross-section and the carriage body engages around the cross-section, at least in part, via at least one bearing sleeve.

9. The surface-treatment appliance according to claim 1, wherein the arcuate guide extends in the form of a circular arc over an angle of at least largely 120°.

10. The surface-treatment appliance according to claim 1, wherein the arcuate guide extends in the form of a circular arc over an angle of at least largely 180°.

11. The surface-treatment appliance according to claim 1, wherein the arcuate guide is configured as a segment of a circle and has first and second spaced-apart terminal ends attached to the base arrangement at an upper side thereof, and the guide plane is defined by first and second points corresponding to the first and second terminal ends of the arcuate guide and a third point corresponding to a location on the arcuate guide disposed between the first and second points.

12. The surface-treatment appliance according to claim 11, wherein at least a portion of the guide part has a longitudinal axis and the joint element permits movement of the portion of the guide part relative to the carriage body about the joint axis of the joint element such that the portion of the guide part is movable into a position in which the longitudinal axis thereof is oriented transversely to the guide plane.

13. A surface-treatment appliance comprising:

a base arrangement mounting a surface-treatment element thereon, said base arrangement being configured for displacement over a surface to be treated;

an arcuate guide mounted on said base arrangement;

a carriage body mounted on said arcuate guide for linear displacement therealong, said carriage body being supported in a radial direction at two supporting points spaced apart from one another along said arcuate guide; and an elongate guide handle configured for manually manipulating said base arrangement, said guide handle being connected to said carriage body for movement therewith along said arcuate guide relative to said base arrangement, said guide handle being connected to said carriage body by a joint element, said joint element permitting movement of said guide handle relative to said carriage body about an axis defined by said joint element.

14. The surface-treatment appliance according to claim 13, wherein said arcuate guide is configured as a segment of a circle and has a circumferentially extending portion, said carriage body being mounted on said circumferentially extending portion of said arcuate guide for linear displacement therealong, said two supporting points being circumferentially spaced from one another along said arcuate guide.

15. The surface-treatment appliance according to claim 14, wherein said guide handle is connected to said carriage body for movement therewith along said circumferentially extending portion of said arcuate guide to vary a position of said guide handle relative to said base arrangement.

16. The surface-treatment appliance according to claim 13, wherein said guide handle has a longitudinal axis and said joint element permits movement of said guide handle relative to said carriage body about the axis of said joint element and into a position in which the longitudinal axis of said guide handle is oriented transversely to a guide plane, said guide plane being defined by first and second points corresponding to terminal ends of said arcuate guide disposed adjacent said base arrangement and a third point corresponding to a location on said arcuate guide disposed between said first and second points.

17. The surface-treatment appliance according to claim 13, wherein said arcuate guide is arc-shaped and terminates at first and second ends, said first and second ends being attached to said base arrangement at an upper side thereof, said carriage body being linearly displaceable along and relative to said arcuate guide between said first and second ends thereof.

18. The surface-treatment appliance according to claim 17, wherein said guide handle has a longitudinal axis and said joint element permits movement of said guide handle relative to said carriage body about the axis of said joint element such that said guide handle is movable into a position in which the longitudinal axis thereof is oriented transversely to a guide plane, said guide plane being defined by first and second points respectively corresponding to said first and second ends of said arcuate guide and a third point corresponding to a location on said arcuate guide disposed between said first and second points.

* * * * *